US011152723B2

(12) United States Patent
Eicher et al.

(10) Patent No.: US 11,152,723 B2
(45) Date of Patent: Oct. 19, 2021

(54) CONTACT PIN FOR PRESSING INTO A PRINTED CIRCUIT BOARD AND CONTACT ARRANGEMENT

(71) Applicant: Robert Bosch GmbH, Stuttgart (DE)

(72) Inventors: Hermann Eicher, Steingaden (DE); Ralph Habiger, Hohenfurch (DE); Andreas Otto, Hoerselberg-Hainich (DE); Cynthia Halm, Eisenach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 16/639,672

(22) PCT Filed: Aug. 13, 2018

(86) PCT No.: PCT/EP2018/071922
§ 371 (c)(1),
(2) Date: Feb. 17, 2020

(87) PCT Pub. No.: WO2019/034608
PCT Pub. Date: Feb. 21, 2019

(65) Prior Publication Data

US 2020/0251837 A1 Aug. 6, 2020

(30) Foreign Application Priority Data

Aug. 18, 2017 (DE) ..... 10 2017 214 465.3

(51) Int. Cl.
*H01R 12/58* (2011.01)
*H01R 4/58* (2006.01)

(52) U.S. Cl.
CPC ..... *H01R 12/585* (2013.01); *H01R 4/58* (2013.01)

(58) Field of Classification Search
CPC ..... H01R 12/585; H01R 12/58; H01R 43/16; H01R 4/58
See application file for complete search history.

(56) References Cited

U.S. PATENT DOCUMENTS 3,824,554 A 7/1974 Shoholm
4,274,699 A * 6/1981 Keim ..... H01R 12/58 439/637

(Continued)

FOREIGN PATENT DOCUMENTS

CN 103337728 A 10/2013
CN 106463853 A 2/2017

(Continued)

OTHER PUBLICATIONS

International Search Report and Written Opinion dated Oct. 25, 2018 for counterpart International Patent Application No. PCT/EP2018/071922.

(Continued)

*Primary Examiner* — Jean F Duverne
(74) *Attorney, Agent, or Firm* — Timothy J. Klima; Shuttleworth & Ingersoll, P.L.C.

(57) ABSTRACT

An electrically conductive contact pin for press-fitting into a PCB in a Z-direction. The contact pin includes a press-fit zone with a central crosspiece area, and two wing areas adjacent to the crosspiece area, each crosspiece area having two ear areas. The crosspiece area is confined by a crosspiece rectangle and the ear regions are confined by ear rectangles. Corner points of the ear rectangles facing a center of the cross-sectional area coincide with corner points of the crosspiece rectangle. The crosspiece rectangle has a crosspiece width in an X direction of 9-29% of a starting thickness of the contact pin and a crosspiece thickness in a Y direction of 35-55% of the starting thickness. The ear rectangles have an ear width in the X-direction of 40-60% of (Continued)

the starting thickness and an ear thickness in the Y-direction of 15-35% of the starting thickness.

16 Claims, 4 Drawing Sheets

(56) References Cited

U.S. PATENT DOCUMENTS 4,691,979 A * 9/1987 Manska ..... H01R 12/585 439/82
4,728,164 A 3/1988 Lemmens et al.
4,733,465 A * 3/1988 Tanaka ..... H01R 43/16 29/874
4,746,301 A * 5/1988 Key ..... H01R 12/58 439/751
4,878,861 A * 11/1989 Kendall ..... H01R 12/585 439/751
5,487,684 A * 1/1996 Schalk ..... H01R 12/585 439/751
5,573,431 A 11/1996 Wurster
6,098,281 A 8/2000 Rudi
6,875,032 B2 * 4/2005 Tsuchiya ..... H01R 12/585 439/751
7,377,823 B2 * 5/2008 Chen ..... H01R 12/585 439/751
7,491,897 B2 * 2/2009 Watanabe ..... H01R 12/585 174/266

FOREIGN PATENT DOCUMENTS

DE 8404681 1/1985
DE 112013004922 A1 7/2015
EP 0132704 A2 2/1985
EP 0152769 8/1985
EP 0152769 A2 8/1985
EP 0841719 A2 5/1998

OTHER PUBLICATIONS

German Office Action dated Jun. 11, 2018 from counterpart German App No. 10 2017 214 465.3.
Chinese Office Action dated Sep. 14, 2020 from counterpart Chinese Patent Application No. 201880052970.2.

* cited by examiner

CONTACT PIN FOR PRESSING INTO A PRINTED CIRCUIT BOARD AND CONTACT ARRANGEMENT

This application is the National Phase of International Application PCT/EP2018/071922 filed Aug. 13, 2018 which designated the U.S.

This application claims priority to German Patent Application No. DE102017214465.3 filed Aug. 18, 2017, which application is incorporated by reference herein.

FIELD OF THE INVENTION

The invention relates to a contact pin for press-fitting into a printed circuit board and a contact arrangement comprising a contact pin and a printed circuit board.

PRIOR ART

Printed circuit boards may be used for a multitude of applications, for example creating circuits comprising a plurality of electrical or electronic components, wherein connections of the components or cables or wires, respectively, may electrically be connected to conductive tracks of the printed circuit board. One approach to achieve this is the so-called press-fit technique. A contact pin may be press-fitted into a channel-like through-hole or recess in the circuit board, wherein the through-hole passes through two opposite sides of the circuit board. The contact pin has a larger diameter than the through-hole or recess, at least in some sections of the press-fit zone. When being press-fitted, the contact pin is crimped at least in the press-fit zone. To allow crimping, the contact pin, in the non-press fitted preassembled state (first state), may be widened in the crimp zone in the manner of a needle eye, so that the portions of the expansion opposite to each other represent elastically resilient regions. Then, these portions counteract inward deformation (towards each other) occurring during press-fitting by a spring force, which, in a second state (press-fit state), frictionally or force-fittingly retains the contact pin in the through-hole.

From DE 11 2013 004 922 T5, such a contact pin is known, comprising a crimp zone widened in the manner of a needle-eye.

In other embodiments, the contact pin, in the crimp zone, may comprise a centrally located thin crosspiece area having small cross-sectional area, which is formed such that it will be deformed during the press-fitting process and, as a result of this deformation, the spring force will be applied, retaining the contact pin in the through-hole in a force-fitting or frictional manner.

From EP 0 152 769 B1, such a contact pin is known.

DISCLOSURE OF THE INVENTION

It has been shown that, with conventional contact pins, the crimp zone, as viewed along the press-fit direction, is required to be relatively long in relation to the thickness of the printed circuit board, so that, with a crimp zone of the type formed as a needle eye, sufficiently large spring force will be provided for creating force-fitting or frictional connection in the through-hole, in order for the contact pin to meet the requirements for providing minimum necessary pull-out force directed against the press-fit direction. The length of the widening required may result in that a free front end of the contact pin, as viewed in the press-fit direction, in the state of the contact pin being completely press-fitted (second state), considerably projects beyond the side of the printed circuit board located downstream of the press-fit direction (herein, downstream only means a directional indication, and no electrical current)—thus, the projecting portion forms a so-called projection. This may be disadvantageous if multiple printed circuit boards are to be stacked on top of each other, for example in an electrical device, e.g. a control unit, as the projection prevents the printed circuit boards from being arranged closer together. Furthermore, such projection may form an antenna, e.g. in high-frequency applications, if the contact pin is energized with high-frequency current. This may have undesirable effects on adjacent electrical or electronic circuits.

If, on the other hand, the resilient region will exclusively be formed by the crosspiece area, which crosspiece area deforms whereas the wing areas which are adjacent to the crosspiece area on both sides do not deform, there will be the risk, on the one hand, for the crosspiece area not to be able to apply sufficient spring force for retaining the contact pin in the through-hole during service life.

Furthermore, there is a risk that the ear areas formed adjacent to each of the wing areas, due to their stiffness, could damage the inner walls of the through-hole during press-fitting or during subsequent vibration loads, which could lead to failure of the printed circuit board. The consequence may be that the distances between two adjacent through-holes is required to be selected greater than it is desirable, in order to reduce such punctual loads onto the walls of the through-holes without damage. This undesirably reduces possible packing density of a printed circuit board in the lateral direction.

In addition, the current-carrying capacity may be limited, as only a small portion of the outer contour of the crimp zone is in mechanical and therefore also electrical contact with the through-hole, and in some cases there is even nothing but punctual contact.

Moreover, in such an embodiment, it may be required to stamp or form the contact pin of a strip material, for example, which has significant smaller diameter than the through-hole. This may result from the fact that, in order to produce a deformable central crosspiece area, the starting material in the crimp zone is required to be crimped such that sufficient material will flow into the outer regions to make the crosspiece area thin enough for being the only one to be deformed during press-fitting into the through-hole, but not the wing areas. Selecting such type of starting material will also reduce the current-carrying capacity.

There may therefore be a need to provide an electrically conductive contact pin for press-fitting into a through-hole or opening or through-connection of a printed circuit board, respectively, which may be manufactured at minimum cost, e.g. from conventional strip material, wherein the current-carrying capacity is increased for a given through-hole diameter in a printed circuit board compared to a conventional contact pin, which in the state of being completely press-fitted minimally projects beyond the printed circuit board, and yet having high retention force due to frictional or force-fitting connection in the printed circuit board, while the walls of the through-hole are not subjected to excessive point load.

Advantages of the Invention

This need may be met by the subject of the present invention according to the independent claims. Advantageous embodiments of the present invention are described in the dependent claims.

The terms "comprising" and "having" are synonymously used throughout the application, unless otherwise expressly stated.

According to a first aspect of the invention, an electrically conductive contact pin is provided for press-fitting into a through-hole of a printed circuit board along a pressing direction.

For the contact pin, the press-fit direction is defined as being the Z-direction, an X-direction is defined perpendicular to the Z-direction, and a Y-direction is defined perpendicular to the Z-direction and the X-direction. The contact pin comprises a crimp zone, which crimp zone, in a cross-sectional area of the contact pin is spanned across the X-direction and the Y-direction, comprising:

a central crosspiece area having two opposite crosspiece edges which are substantially parallel to the X-direction, two wing areas adjacent to the crosspiece area in positive X-direction and negative X-direction, wherein each wing area comprises two ear areas, wherein one ear area of each wing area projects beyond the crosspiece area in positive Y-direction, and another ear area of each wing area projects beyond the crosspiece area in negative Y-direction. In other words, the ear areas are to be understood as that continuous surface of the cross-section which, as viewed from the center of gravity, is further spaced apart from the center of gravity in the Y-direction than the adjacent crosspiece edge or edge of the crosspiece area. Any one crosspiece edge or edge of crosspiece area or extension thereof, respectively, thus limits one ear area in the Y-direction. The crosspiece area is limited by a crosspiece rectangle. The ear areas are limited by ear rectangles, wherein inner corner points of the ear rectangles facing a center of gravity of the cross-sectional area coincide with corner points of the crosspiece rectangle. The crosspiece rectangle, in the X-direction, has a crosspiece width of between 9% and 29% of a starting material thickness of the contact pin, preferably between 14% and 24%, especially preferably 19% of the starting material thickness. In the Y-direction, the crosspiece thickness is between 35% and 55% of the starting material thickness, preferably between 40% and 50%, especially preferably 45% of the starting material thickness. In the X-direction, the ear rectangles have an ear width of between 40% and 60% of the starting material thickness, preferably between 45% and 55%, especially preferred 50%. The ear rectangles in the Y-direction have an ear thickness of between 15% and 35% of the starting material thickness, preferably between 20% and 30%, especially 25% of the starting material thickness.

By crosspiece rectangle, minimal rectangles are to be understood, into which the respective surface area of the crosspiece area may just precisely and completely be fitted. Extension in the Y-direction thereof is limited by the two crosspiece edges essentially extending along the X-direction. In the X-direction, the crosspiece rectangle extends to the points where the side surfaces of the ear areas facing each other, as seen in the X-direction, hit the respective crosspiece or edge of the crosspiece area or the crosspiece rectangle, respectively. Therefore, the crosspiece rectangle is kind of a virtual rectangle.

The ear rectangles are to be understood as minimum rectangles, into which the respective surface area of an ear area may just precisely and completely be fitted. An inner corner point of an ear rectangle is indicated by a corresponding corner point of the crosspiece rectangle. Furthermore, starting from this common point, one edge of the respective ear rectangle passes through this point in extension of the crosspiece edge or edge of the crosspiece rectangle extending in the X-direction. Therefore, the ear rectangles are as well to be considered as a kind of virtual rectangles.

If the crosspiece rectangle and the four ear rectangles are plotted into the cross-section of the contact pin in the crimp zone, an arrangement like the five spots of a dice's 5 may preferably arise, wherein the crosspiece rectangle exactly shares one corner point with each ear rectangle, and all edges of the rectangles extend in the X-direction or Y-direction.

This contact pin may be produced advantageously and especially at low cost, e.g. from conventional strip material. For a given diameter of a printed circuit board through-hole, the contact pin has an increased current-carrying capacity compared to prior art contact pins and, advantageously, minimally projects beyond the printed circuit board when being completely press-fitted.

Due to its specific geometry, the ear areas are inwardly deformed, i.e. away from the walls of the through-hole, while the crosspiece area is only deformed slightly or not at all. This, among others, is due to an essentially rectangular shape having high area moment of inertia. In addition—due to the manufacturing process, e.g. by introducing a bead into the starting material, e.g. the strip material—the starting material may be crimped in the crosspiece area, so that it will be especially hard or hardened in this region. This means that for the same diameter of a through-hole, a strip material may be selected as a starting material having larger external dimensions, i.e. greater material thickness, than conventional contact pins, which increases the current-carrying capacity, for example. The press-fitted contact pin has high filling factor in the through-hole due to the stable crosspiece area.

As a result, force-fitting or frictionally engaged, resilient retention force is provided due to a much larger surface than with conventional contact pins, i.e. by the outer contour of the ear areas. At the same time, the point load applied to the walls of the through-hole will be reduced, thus reducing the risk of damage to the printed circuit board and/or reducing the distances between adjacent through-holes—with the through-hole having the same diameter. Finally, deformability of the ear areas during press-fitting results in larger contact region (contact area) against the metallized inner wall of the through-hole, so that the contact region for current between the through-hole and the contact pin increases, which in turn increases the current-carrying capacity.

For example, the contact pin may be manufactured from an electrically conductive starting material or a semi-finished product, which has a square starting cross-section where a starting material thickness corresponds to an edge length (e.g. a so-called strip material, which is available as a long strand, for example). To create a crimp zone for deforming, the initial cross-section (e.g. square, rectangular, circular, etc.) may be processed in the crimp zone from two opposite surfaces or side surfaces. The specific cross-section of the crimp zone is created in the crimp zone, which may figuratively be described as a dumbbell-shaped cross-section, for example: it results from the central crosspiece area and the two wing areas, wherein the crosspiece area may be seen as a dumbbell bar and the wing areas as dumbbell weights attached to the side of the dumbbell bar. Outside the crimp zone, i.e. as viewed along the crimp zone direction or the z-direction, the original cross-section may essentially be retained. For example, the crimp zone may essentially be as long as the thickness of the intended printed circuit board, but in the case of the contact pin presented herein, it may as well be slightly longer, e.g. a maximum of 140%, preferably a maximum of 120%, or even shorter, especially preferably a maximum of 100% or a maximum of 80% or a maximum of 50% of the thickness of the printed circuit board. The printed circuit board may have a thickness in the range of between 0.8 mm and 2.4 mm, especially preferred between 1.2 mm and 2.0 mm, e.g. at 1.4 mm, 1.55 mm, 1.6 mm, 1.8 mm, 2 mm or 2.4 mm.

For the (dumbbell-shaped) cross-section in the crimp zone, a bead may be stamped into opposite surfaces or side surfaces from opposite processing directions, for example. For example, the bead may centrally be stamped into the surface areas or lateral surfaces. A bead is to be understood as an elongated recess having an essentially constant cross-section. Material from the surface areas or the lateral surfaces will be pressed in the processing directions towards a center or center of gravity of the cross-section and subsequently will be passed transversely to the processing directions. Unprocessed areas in the surfaces or lateral surfaces of the crimp zone may be curved convexly, for example, and the crosspiece area and the two wing areas including the two ear areas will individually be formed. An axis transversally to the processing directions may be referred to as the X-axis. One axis of the processing directions may be referred to as the Y-axis. A longitudinal axis of the contact pin or the beads may be referred to as the Z-axis. For example, a width of the crimp zone in an X-direction of the X-axis may become larger than the starting material thickness, due to the flowing material. The width may be between 13% and 33%, especially between 18% and 28%, especially 23% or 25%, larger than the starting material thickness in the non-press-fitted state. In a Y-direction of the Y-axis, a maximum thickness of the crimp zone may, only by way of example, essentially still correspond to the starting material thickness. However, expansion in the Y-direction (between two ear areas opposing each other in the Y-direction) may as well be smaller or larger. For example, the Y-direction expansion may be between 65% and 125% of the starting material thickness, preferably between 90% and 110% of the starting material thickness, depending on how the material flows into the ear areas.

For example, the bead may have a substantially flat bead base. The bead base then forms a surface of the crosspiece area, thus corresponding to the crosspiece edge. Bead flanks of the bead may, for example, be designed as being inclined and, for example, may also be planar on their surface. The bead flanks form the lateral surfaces of the ear areas facing each other along the X-direction. A transition between the bead base and the bead flank defines the common corner point of the crosspiece rectangle and the corresponding ear rectangle. This transition may for example be essentially sharp-edged or may as well be round-blunted. A transition from a side surface of the ear area or the side of the bead facing the inner side of the bead to a section of the ear area facing away from the crosspiece area and extending essentially in X-direction may be round-blunted, so that the side surface or the side of the bead smoothly merges into this section.

The crosspiece area is essentially rectangular, with the crosspiece area rather extending in the Y-direction than in the X-direction. This makes the crosspiece area very rigid. The ear areas have an approximate rectangular shape or can be inscribed into a minimal rectangle. They are thinner in the Y-direction than in the X-direction. Due to the presence of the bead, the material may be displaced from the ear areas in the direction of the bead when press-fitting the contact pin into the through-hole.

In the approach presented herein, a geometry is provided that allows the press-fit pins to be manufactured of a variety of materials, especially soft or easily flowable or ductile materials. The geometry may be suitable for press-fitting into the through-hole of the printed circuit board without any damage.

The fact that an edge distance between two edges of two ear rectangles facing away from the center of gravity and opposite to each other relative to the center of gravity is between 129% and 149%, especially between 134% and 144%, especially 139% of the starting material thickness, has the advantage that the crosspiece area will minimally be deformed during the press-fit process and deformation will mainly occur in the ear areas. This is because increase of edge distance compared to the starting material thickness means that material has been pressed or stamped or passed from the center to the outer regions, i.e. the ear areas, and that, at the same time, the central crosspiece area has been strengthened.

Preferably, the edge distance extends in X-direction, this means: the opposite edges are the outer edges of two ear rectangles extending in the Y-direction. Therefore, when cutting along the X-direction the following sequence may occur: ear area-bead-ear area.

The fact that a diagonal distance between the outer corners of two ear rectangles, which are diametrically opposed to each other with respect to the center of gravity, is between 145% and 165% of the starting material thickness results in especially large filling factor in a through-hole and thus especially high current-carrying capacity.

An outer contour of an ear area, which faces towards an outer corner of the associated ear rectangle, round-blunted with a radius between 6% and 26%, especially between 11% and 21%, especially 16%, of the starting material thickness, has the advantageous effect for the contact pin in the crimp zone not to have any sharp edge which may come into contact with the wall or a coating of the wall of the through-hole during crimping. This advantageously prevents the risk of point load and thus damaging the wall or a metal coating of the through-hole of the printed circuit board. Round-blunting reduces mechanical stress on the hole when press-fitting (radial force will be distributed across a larger area, thus reducing the pressure). Furthermore, round-blunting results in that the convexly projecting side surface of the crimp zone already advantageously approaches the contour of the hole, so that, in the state of being completely press-fitted (second state), a larger contact surface will be created, thus also creating higher current-carrying capacity.

The fact that a round-blunting distance measured on the diagonal distance line between two outer contours located opposite to each other in relation to the center of gravity is between 129% and 149%, especially between 134% and 144%, especially 139% of the starting material thickness advantageously results in that the crosspiece area will minimally be deformed in the press-fit process and deformation predominantly will occur in the ear areas. This is because the increased edge distance compared to the starting material thickness means that material has been pressed or stamped or flowed from the center to the outer regions, i.e. the ear areas, and at the same time the centrally located crosspiece area has been strengthened. Furthermore, by performing round-blunting, the diagonal distance may very specifically be adapted in relation to the diameter of the hole so that sufficiently strong retention force will be achieved without applying excessive load to the wall of the hole during the press-fit process.

The fact that at least one ear area comprises a bevel at a side facing the crosspiece area in the X-direction, wherein the bevel has an angle in relation to the crosspiece edge of the crosspiece rectangle of the crosspiece area, the angle being between 95° and 135°, especially between 105° and 128°, especially 120°, has the advantage that the ear areas have a progressive spring characteristic curve. The ear areas counteract increasing deformation during press-fitting with a strongly increasing counter force. This results in excellent retention force while requiring relatively low press-fit force. In addition, an especially simple manufacturing process for incorporation a bead is achieved.

A further development provides for the ear areas to be arranged and designed essentially mirror-symmetrically to each other with regard to the crosspiece area. In other words, all four ear areas have essentially the same basic shape. This basic shape of an ear area may be transformed into the shape of each one of the other three ear areas by one or two mirroring(s) at the crosspiece area, preferably at the center of gravity or at a mirroring line parallel to the X-axis or to the Y-axis passing through the center of gravity.

This will advantageously result in that the compressive forces during press-fitting are symmetrically introduced into the printed circuit board. In this way, high packing density of the electrical contact pins or press-fit pins in the circuit board may be achieved.

A further development provides for the contact pin to have a tip region in the Z-direction immediately adjacent to the press-fit zone and extending to a free end of the contact pin, the cross-section of the contact pin tapers in the tip region towards the free end, the tip region has a tip region length in the Z-direction of between 60% and 300%, preferably between 60% and 150%, especially preferably between 80% and 120% or between 95% and 105%, especially 100%, of the starting material thickness.

On the one hand, this configuration ensures for the contact pin to be smoothly inserted into the through-hole, as the tip can compensate for a lateral positioning tolerance when placing the contact pin above the through-hole immediately before starting press-fitting. At the same time, this geometry advantageously minimizes any projection of the free end, i.e. the tip region, beyond the printed circuit board in the state of being completely press-fitted, so that the contact pin does not, or only slightly, act as an antenna and the stacking density of printed circuit boards on top of each other may also be increased.

The fact that the starting material predominantly comprises a material selected from the group consisting of aluminum, an aluminum alloy, copper, a copper alloy, bronze and brass, e.g. at least 50%, preferably at least 75% and especially preferably at least 98%, has the advantageous effect that the contact pin may be manufactured at low cost. Among all materials proposed, strip material having the conventional dimensions of e.g. 0.4×0.4 mm2, 0.6×0.6 mm2, 0.8×0.8 mm2, 1.0×1.0 mm2 or 1.2 mm2 may be purchased at low cost. In the context of the specific contact pin geometry, it is possible to achieve sufficiently high retention force in the through-hole even when using material which may very easily be deformed, e.g. aluminum, without creating a large projection length beyond the printed circuit board, even with printed circuit boards having a thickness in the range between 0.8 mm and 2.4 mm, e.g. 1.55 mm or 1.6 mm. Especially aluminum is an excellent conductor and, at the same time, a very cost-effective material. At the same time, with ductile (good easily deformable) materials such as aluminum, the specific geometry of the contact pin has the advantage that the crosspiece area will minimally be deformed, and that it especially is the ear areas that will be deformed, resulting in an especially large contact area and thus current-carrying capacity with regard to the through-hole.

According to a second aspect of the invention, a contact arrangement is provided, comprising:

- a printed circuit board comprising a through-hole, especially cylindrical, especially metallized, extending along the Z-direction,
- a contact pin as described above, wherein the contact pin is crimped in the through-hole.

The through-hole penetrates the printed circuit board like a channel.

The printed circuit board may be a rigid printed circuit board, for example. It may be made of FR4 or any superior material.

The contact pin may be press-fitted into the through-hole using ultrasonic assistance or not.

This contact arrangement may advantageously be produced at very low cost. For a given diameter of the through-hole of the printed circuit board, it has increased current-carrying capacity, as compared to conventional contact arrangements and, advantageously, has very small projection beyond the printed circuit board when the contact pin is in the state of being completely press-fitted.

Due to the specific geometry of the contact pin, it will advantageously be achieved that, during press-fitting, especially edge areas or dedicated edge areas, i.e. the ear areas, will inwardly be deformed, i.e. away from the walls of the through-hole, while the crosspiece area is subject to only slight or no deformation. This means that for the same diameter of a through-hole, a strip material may be selected as the base material, which has larger outer dimensions, i.e. a greater material thickness, than with conventional contact pin, which, for example, advantageously increases the current-carrying capacity of the contact arrangement.

The press-fitted contact pin has a high filling factor in the through-hole due to the stable crosspiece area. As a result, the force-fittingly or frictionally engaged resilient retention force of the contact pin in the through-hole is provided by a much larger surface area than with conventional contact pins, namely by a large region of the outer contour of the ear areas instead of being provided only punctually at the corners of the cross-section of the crimp zone. At the same time, the punctual load onto the walls of the through-hole will decrease, thus reducing the risk of damage to the printed circuit board and/or reducing the distances between adjacent through-holes—while maintaining the same diameter of the through-hole. Finally, deformability of the ear areas during press-fitting results in a larger contact area against the metallized inner wall of the through-hole, so that the transition area for current between the through-hole and the contact pin increases, which also advantageously increases the current-carrying capacity of the contact arrangement.

Another further development provides for the printed circuit board to have a thickness (hereinafter also referred to as a thickness of the printed circuit board or printed circuit board thickness) between two opposite sides, a first side and a second side, as viewed along the Z-direction, wherein in the state of the contact pin being completely press-fitted, a frontal free end of the contact pin, as viewed along a press-fit direction, projects in the Z-direction beyond one side of the printed circuit board along a length, the length being in a range between 10% and 300%, preferably between 10% and 110%, especially between 45% and 55%, especially 50% or 100%, of the thickness of the printed circuit board. The length may be referred to as projection.

The thickness of the printed circuit board or the printed circuit board thickness may, for example, be in a range between 0.5 mm and 3 mm, preferably between 0.8 mm and 2.4 mm, particularly preferably between 1.2 mm and 2.0 mm, e.g. at 1.4 mm, 1.55 mm, 1.6 mm, 1.8 mm, 2 mm or 2.4 mm.

This has the advantage that only a very small projection of the contact pin or press-fit pin will be created. This means that such a contact pin does not act as an antenna (transmitting antenna or receiving antenna) in high-frequency applications, or at least only to a lesser extent. At the same time, printed circuit boards may be positioned or stacked more closely relative to each other along the Z-direction, resulting in more compact devices or electronic assemblies. Due to the small projection, high packing density between several printed circuit boards may be achieved. The risk of short circuits may be reduced. Material may be saved.

As the through-hole has a diameter of between 113% and 133%, especially between 118% and 128%, especially between 120% or 123% or 125%, of the thickness of the starting material, a sufficiently large diameter of the through-hole will be provided to prevent damage to the wall of the through-hole when performing pressed-fitting. At the same time, the through-hole is narrow enough so that when the contact pin having specific geometry is press-fitted, it is mainly the ear areas that will be deformed, thus providing excellent retention force and very large contact surface having very high current-carrying capacity. Such small through-hole diameters, as compared to the starting material thickness, cannot be achieved with conventional contact pin geometries in the crimp zone. Surprisingly, the specific geometry of the contact pin's crimp zone allows simultaneous optimization of the following parameters: retention force (even when using very soft materials), press-fit force, point load to the wall of the through-hole, current-carrying capacity, manufacturing costs of the contact pin when using conventional strip material.

For example, a strip material having preset starting material thickness dimensions of e.g. 0.4×0.4 $mm^2$, 0.6×0.6 $mm^2$, 0.8×0.8 $mm^2$, 1.0×1.0 $mm^2$ or 1.2 $mm^2$ may be used to achieve a contact hole diameter of e.g. 0.5 mm (matching 0.4×0.4 $mm^2$), 0.75 mm (matching 0.6×0.6 $mm^2$), 1.0 mm (matching 0.8×0.8 $mm^2$), 1.25 mm (matching 1.0×1.0 $mm^2$) or 1.45 mm (matching 1.2×1.2 $mm^2$).

As a through-hole distance from the through-hole to an adjacent through-hole of another contact pin, as described above, is between 300% and 425%, especially between 330% and 390%, especially 364%, of the starting material thickness, packing density of the press-fit pins or contact pins in the printed circuit board is allowed to be advantageously increased without increasing life of the through-holes or scrap material created due to damage to the through-holes. This allows reduction of cost of electronic components, which cost will also be largely determined by the printed circuit boards. Surprisingly, it is the specific geometry of the crimp zone that allows this increase in packing density of contact pins in the printed circuit board. It is the forces which are evenly introduced into the circuit board and the predominant deformation of the ear areas that allows the holes to be located close together. This allows many different electrical contacts to be arranged on a small surface area.

This applies specifically to relatively thin printed circuit boards, having a thickness e.g. in a range between 0.5 mm and 3 mm, preferably between 0.8 mm and 2.4 mm, particularly preferably between 1.2 mm and 2.0 mm, e.g. having a thickness of 1.4 mm, 1.55 mm, 1.6 mm, 1.8 mm, 2 mm or 2.4 mm.

It should be noted that some of the possible features and advantages of the invention will be described herein with respect to different embodiments. A person skilled in the art recognizes that the features of the contact pin and the printed circuit board may suitably be combined, adapted or exchanged to achieve other embodiments of the invention.

BRIEF DESCRIPTION OF THE DRAWINGS

In the following, embodiments of the invention will be described while making reference to the accompanying figures, neither the drawings nor the description being intended to limit the invention, wherein.

The figures are schematic diagrams only, and not to scale. Equal reference numbers in the figures indicate identical or equivalent features.

EMBODIMENTS OF THE INVENTION

Figure 1:
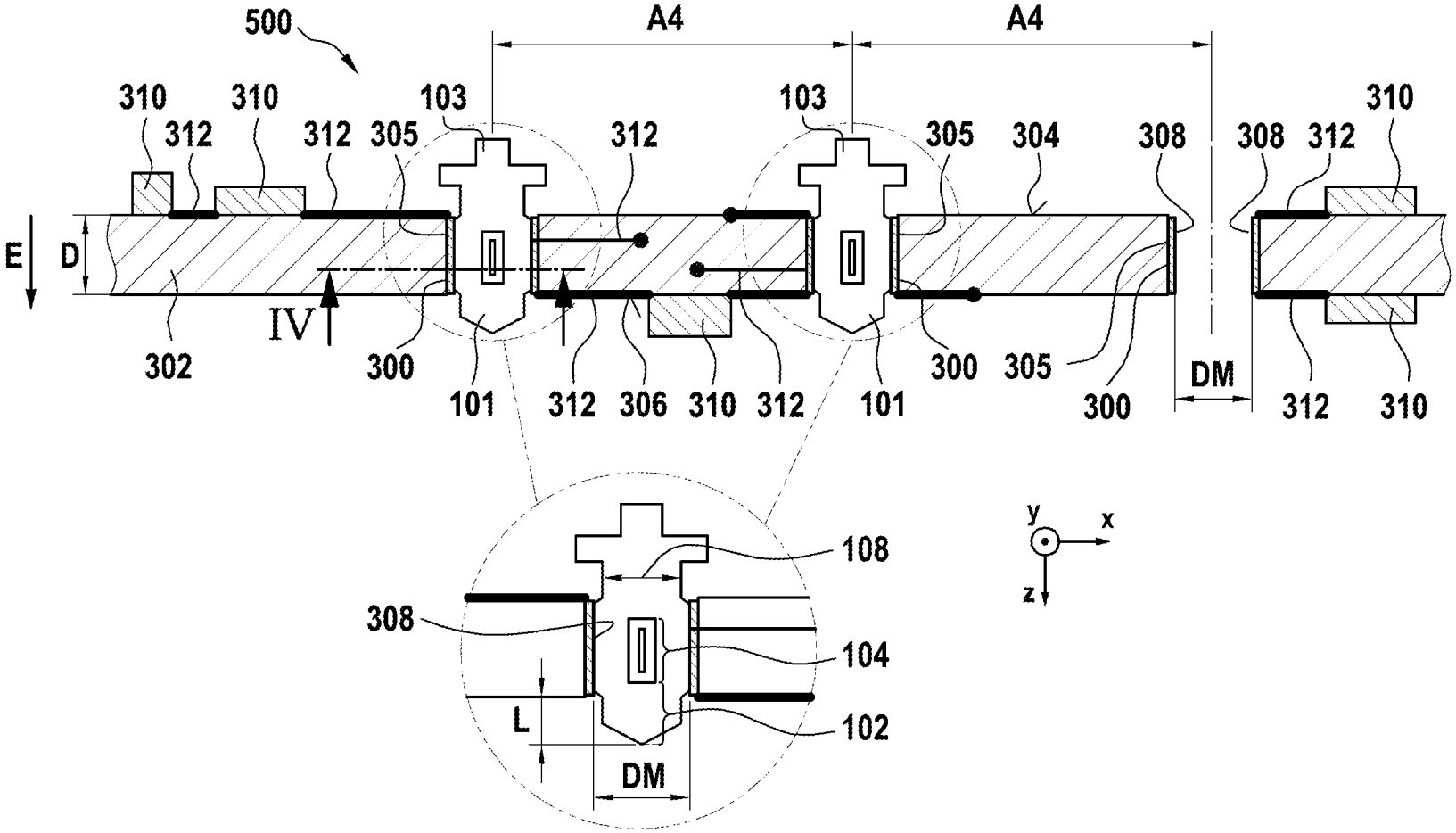
FIG. 1 is a schematic cross-section of a contact arrangement.

FIG. 1 shows an electrical contact arrangement 500. The contact arrangement 500 comprises:

- a printed circuit board 302 having a through-hole 300 extending along a Z-direction,
- an electrical contact pin 100, which is crimped in the through-hole 300 or press-fitted into the through-hole 300, respectively.

For example, the printed circuit board 302 may be a rigid printed circuit board 302. It may be made of FR4 material or any superior material (FR-5, FR6, etc.). The printed circuit board 302 may for example be a single layer printed circuit board. However, it may also comprise two layers or even more than two layers. The printed circuit board 302 has a first side 304, which may be referred to as the top side or front side (top side in the figure). The printed circuit board 302 also has a second side 306, which is opposite to the first side 304 and may be referred to as the bottom side or back side. The printed circuit board 302 may also comprise at least one conductive track 312. The at least one conductive track 312 may be located at the first side 304 and/or the second side 306. However, the at least one conductive track 312 may also be located inside the printed circuit board 302. Furthermore, in the exemplary example embodiment shown, electrical or electronic components 310 are arranged at both sides 304, 306 of printed circuit board 302. They may be formed as SMD ("surface mounted device") elements, for example. They may comprise resistors, capacitors, coils or integrated circuits (e.g. ASICs).

The printed circuit board 302 has a thickness D, when viewed along the Z-direction, i.e. thickness between the two sides 304, 306. This thickness D may be between 0.8 mm and 2.4 mm, for example, and especially preferred between 1.2 mm and 2.0 mm, e.g. 1.4 mm, 1.55 mm, 1.6 mm, 1.8 mm, 2 mm or 2.4 mm, +/−10% respectively.

There is at least one through-hole 300 introduced into the printed circuit board 302. In the schematic cross-section of printed circuit board 302 three through-holes 300 are represented. The at least one through-hole 300 passes through the circuit board 300 between the two sides 304, 306 like a channel, forming a wall 305. It may be designed as a cylindrical hole, for example. An electrically conductive coating 308 may be provided on the wall 305 thereof. This coating 308 may be formed e.g. by a metallic coating. The at least one through-hole 300 has a diameter DM. This diameter may be between 0.4 mm and 2.5 mm, e.g. 0.6 mm, 0.75 mm, 1.0 mm, 1.45 mm, 1.6 mm or 2.0 mm. In this context, the diameter DM is the diameter of the through-hole 300 including the coating 308.

The through-holes 300 in the printed circuit board 302 are spaced apart from each other in the lateral direction—in the two-dimensional cross-section shown, only the X-direction is represented. Adjacent through-holes 300 have a distance A4 therebetween.

In FIG. 1, two of the three through-holes 300 have electrical contact pins 100 press-fitted thereinto. The contact pins 100 can, for example, be press-fitted into the through-holes 300 using ultrasonic assistance, or conventionally without ultrasonic assistance.

The geometry of the contact pins 100 will be described in more detail below while making reference to the FIGS. 1 and 2.

Figure 2:
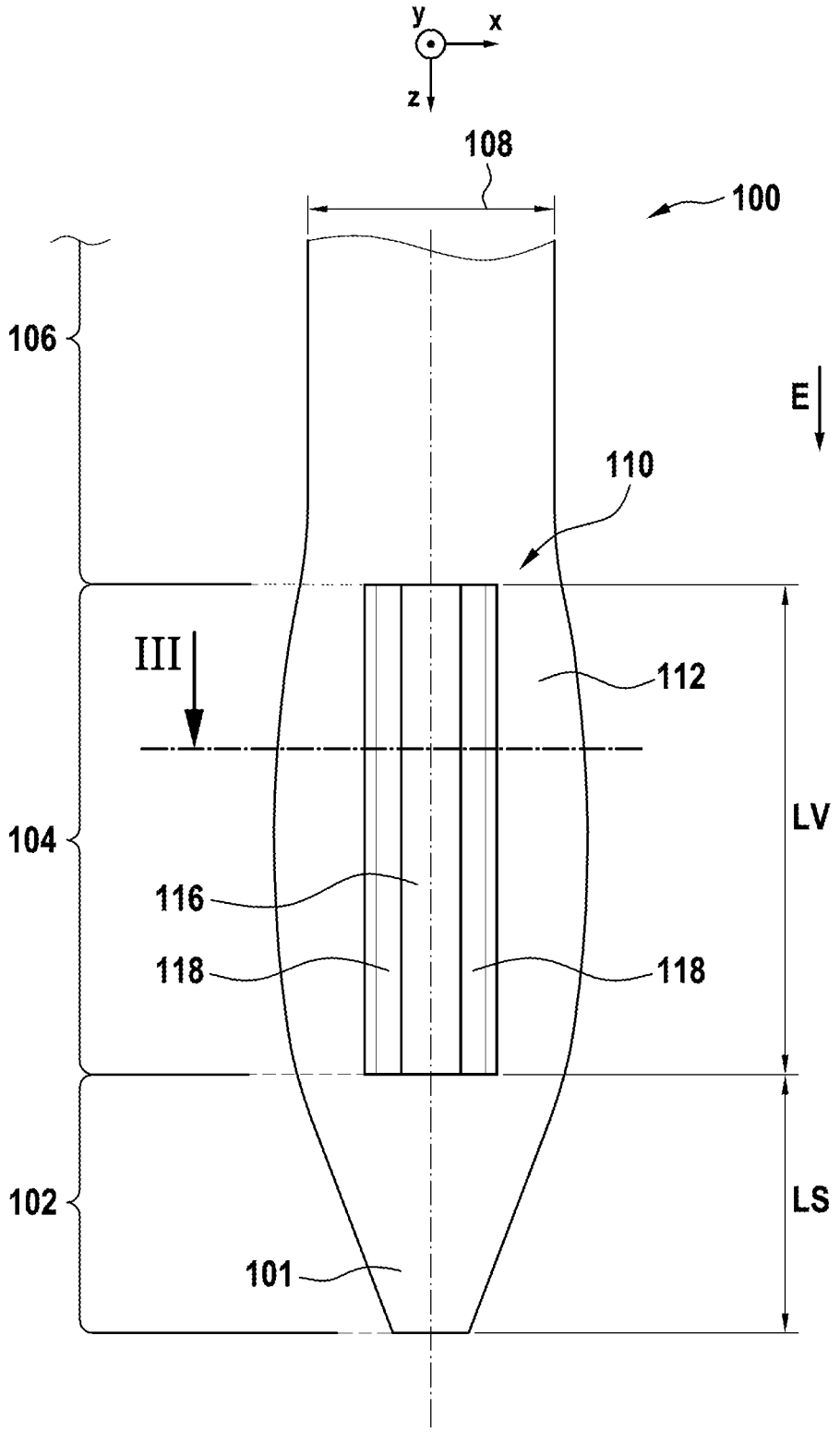
FIG. 2 is a schematic representation of a contact pin in the released (first) state according to an example embodiment.

FIG. 2 shows a contact pin 100 in a first state, in a state before the press-fit process into the printed circuit board 302, a pre-assembly state or pre-crimped state.

In FIG. 1, the two contact pins 100 shown are in state of being completely press-fitted, i.e. in a second state or in a press-fit state.

Figure 3:
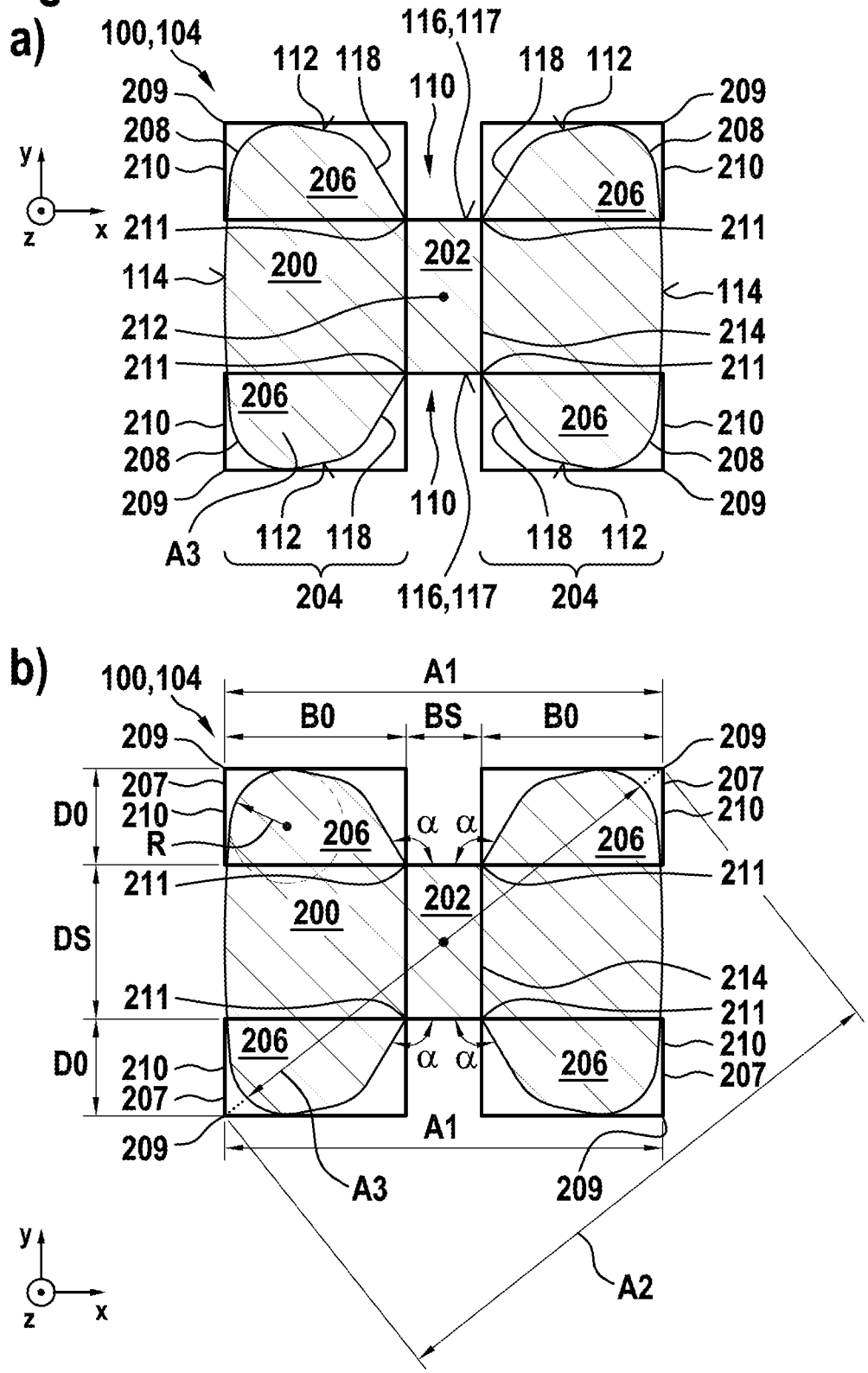
FIG. 3*a* is a schematic view of the cross-section of the crimp zone of the contact pin of FIG. 2 in the released (first) state.
FIG. 3*b* is the cross-section of FIG. 3*a* showing the dimensions.

Preferably, the contact pins 100 are carry-over parts. A contact pin 100 is thus designed for being press-fitted along a press-fit direction E into one of the through-holes 300 of the printed circuit board 302, wherein for the contact pin 100 the press-fit direction E is set as the Z-direction when correctly press-fitted (during assembly processes, slight tilting of the press-fit direction relative to the longitudinal axis of the through-hole 300, which extends in the Z-direction, may occur due to tolerances). An X-direction is located perpendicular to the Z-direction, and perpendicular to both the Z-direction and the X-direction, a Y-direction is located (in FIGS. 1 and 2, the Y-direction points toward the drawing plane). The contact pin 100 comprises a crimp zone 104, which comprises a cross-sectional area 200 of the contact pin 100 spanned in the X-direction and in the Y-direction (see FIGS. 3 and 4).

The contact pin 100 extends along a main extension direction, which herein corresponds to the Z-direction, thus corresponding to the press-fit direction E. When viewing along the press-fit direction E (in FIGS. 1 and 2, i.e. from top to bottom), the contact pin has the following sections or regions, respectively:

First, an unmachined shaft area 106, followed by the press-fit zone 104 and then a tip region 102.

In the shaft area 106, the contact pin 100, at least sectionally, may have its initial cross section. The initial cross-section corresponds to the cross-section of the unprocessed strip material from which the contact pin 100 is made, and may be of square, rectangular, circular shape, etc. In the present example embodiment, a square cross-section is only used as an example. In this case, one edge length of the square corresponds to a starting material thickness 108 of the contact pin 100. In a rectangular, non-square cross-section there is a starting material thickness 108 for each of the two orthogonal directions, in a circular cross-section, it is the diameter which corresponds to the starting material thickness 108.

In the shaft area 106, a shoulder area 103, e.g. having the shape of a cross (see FIG. 1), may also be formed for introducing press-fit forces and/or placing a sonotrode for applying ultrasonic energy while performing a press-fit process. In this shoulder area 103, the contact pin 100 does not have its initial cross-section, but rather a widened cross-section.

Along the press-fit direction E, the press-fit zone 104 follows the shaft area 106, and preferably follows directly. The crimp zone 104 is followed by the tip area 102, which extends up to a free end 101 of the contact pin 100, wherein the cross-section of the contact pin 100 tapers in the tip area 102 towards the free end 101.

The tip area 102 is designed such that it still allows to be inserted into the through-hole 300, even in case of slight lateral misalignment.

In the Z-direction, the tip area 102 has a tip area length LS between 60% and 300% of the starting material thickness 108, preferably between 60% and 150% of the starting material thickness 108, particularly preferably between 80% and 120% of the starting material thickness 108. This tip area length LS of the tip area 102 is measured from the end of the crimp zone 104 facing towards the free end 101 until the end of the free end 101. In FIG. 2, the length of the tip area 102 corresponds to about 100% of the starting material thickness 108.

Contrary to this, the crimp zone 104 is designed to retain the contact pin 100 in the through-hole 300, e.g. by frictional or force-fitting connection. This means that, in the first state (pre-assembly state), the cross-section in the crimp zone 104 has a larger diameter than the diameter DM of the through-hole 300, at least along one line.

The contact pin 100 may be formed of a starting material (the strip material), which comprises a material selected from the group consisting of aluminum, an aluminum alloy, copper, a copper alloy, bronze, brass, in as a predominant proportion. By the predominant proportion, a proportion of at least 50%, preferably of at least 75%, particularly preferably of at least 95% and very particularly preferably of at least 98% is meant. Even if the contact pin 100 is predominantly made of a soft material such as aluminum or an aluminum alloy, it may reliably and safely be crimped with the cross-section in the crimp zone 104 in the through-hole 300 as shown below, i.e. it will be retained therein for whole service life, e.g. even under vibration loads. The choice of material also ensures good electrical conductivity.

When the contact pin 100 is press-fitted into the through-hole 300, an interference fit is created between the crimp zone 104 and the wall 305 or the coating 308 of the through-hole 300 or the hole in the printed circuit board 302. This provides for electrical and mechanical contact to the printed circuit board 302. The crimp zone 104, for example, may have a crimp zone length LV that corresponds to the thickness D of the printed circuit board 302, wherein the printed circuit board 302 may have a thickness D in the range between 1 mm and 2 mm, e.g. 1.6 mm+/−10%. However, the length LV of the crimp zone of the contact pin 100 presented herein, may as well be slightly longer and, for example, be at most 140%, preferably at most 120% of the thickness D. It is especially preferred that the crimp zone length LV may also be shorter than the thickness D of the printed circuit board 302, e.g. 100%, at most or 80% at most or 50% at most of the thickness D of the printed circuit board 302.

The crimp zone length LV is measured as the length along the Z-axis where the cross-section of the contact pin 100 has the characteristic shape shown of FIGS. 3*a*, 3*b*. If this shape is created by insertion of a bead 110, the crimp zone length LV may be considered to be the length of the bead.

In the state of being press-fitted (second state), the crimp zone 104 may be completely within the printed circuit board 302, i.e. between the two sides 304, 306. However, the crimp zone 104 may as well partially project beyond at least one of the two sides 304, 306.

In the state where the contact pin 100 is completely press-fitted (second state), the free end 101 of the contact pin 100 projects in the Z-direction or along the press-fit direction E along a length L beyond the second side 306 of the printed circuit board 302, the length L being in a range between 10% and 300% of the thickness D of the printed circuit board 302, preferably between 10% and 110%, particularly preferably only between 45% and 55%, in particular 50%, of the thickness D of the printed circuit board 302. The length L may be referred to as a projection.

By way of example only, the crimp zone 104 may be formed of two beads 110 stamped into a blank of the contact pin 100. The blank may be formed of any conventional strip material. For example, the beads may be centrally stamped into two opposite surfaces 112 of the blank. The beads 110 may extend along the entire crimp zone 104. The beads 110 are depressions from which material of the blank has laterally been displaced towards an X-direction. As shown in the figure, the displaced material allows the cross-section of the crimp zone 104 to project beyond the initial cross-section at least along one axis. The cross-section may be crowned. Due to the displaced material, the crimp zone 104 in the figure shown is wider than the starting material thickness 108 at least in the X-direction.

In this example, a bead 110 has a substantially trapezoidal cross-section with a bead base 116 and bead flanks 118 or bevels 118 at an angle in relation to the bead base 116. In the example embodiment shown, where a strip material having square cross-section is used, the bead base 116 may be formed substantially parallel to the surface 112 and extending along the X-axis, for example.

Transitions between the bead flanks 118 and the bead base 116 may be sharp-edged or may be stamped using very small radius. The surface 112 of the contact pin 100 may be bent in slightly concave manner in the area of the bead 110 as a result of the stamping process.

FIGS. 3*a* and 3*b* show a schematic view of a cross-sectional area 200 of the crimp zone 104 of the contact pin 100 of FIG. 2 in the uncrimped (first) state. Both figures are identical with regard to the cross-section shown. For reasons of clarity, however, the dimensioning of different dimensions has been transferred to a separate FIG. 3*b*.

Herein, the cross-sectional area 200 of contact pin 100 comprises:

- a central crosspiece area 202 having two opposite crosspiece edges 117 or edges 117, which are essentially parallel to the X-direction,
- two wing areas 204 adjacent to the crosspiece area 202 in positive X-direction and negative X-direction, each wing area 204 having two ear areas 206.

One ear area 206 of each wing area 204 extends in the positive Y-direction and another ear area 206 of each wing area 204 extends in the negative Y-direction beyond the crosspiece area 202.

The crosspiece area 202 is limited by a crosspiece rectangle 214 which corresponds to a minimum rectangle which is just sufficiently large to confine the complete surface area of the crosspiece area 202. The edges of the crosspiece rectangle 214 extend parallel to the X direction and parallel to the Y direction.

The ear areas 206 are confined by the ear rectangles 210, which, like the crosspiece rectangle 214, are each minimum rectangles, into which the surface area of the individual ear areas 206 are just exactly inscribed.

Inner corner points 211 of the ear rectangles 210 facing a center of gravity 212 of the cross-sectional area 200 correspond to corner points of the crosspiece rectangle 214, each ear rectangle 210 having a common corner with the crosspiece rectangle 214 and vice versa, each corner of the crosspiece rectangle 214 being assigned to exactly one ear rectangle 210.

The crosspiece rectangle 214 has a crosspiece width BS in the X-direction of between 9% and 29%, especially between 14% and 24%, especially 19%, of a starting material thickness 108 of the contact pin 100 and has a crosspiece thickness DS in the Y-direction of between 35% and 55%, especially between 40% and 50%, especially 45%, of the starting material thickness 108 (see FIG. 3*b*).

The ear rectangles 210 have an ear width BO in the X-direction of between 40% and 60%, especially between 45% and 55%, especially 50% of the starting material thickness 108 and in the Y-direction an ear thickness DO between 15% and 35%, especially between 20% and 30%, especially 25%, of the starting material thickness 108 (see FIG. 3*b*).

In other words, a cross-sectional area 200 will result, which may figuratively be described as being dumbbell-shaped, wherein the crosspiece area 202 may represent the dumbbell bar 202, and the two wing areas 204 representing two weight elements attached to the sides of the bar. Each one of the ear areas 206 projects beyond the plane of the dumbbell bar, i.e. the crosspiece area 202. In the schematic FIGS. 3*a* and 3*b* shown, the surface areas of the four ear areas 206 can completely be transformed into each other by a rotation around the center of gravity 212 (e.g. by integer multiples of 90°) or by one or two mirroring(s) about one or two axes or a point mirroring at the center of gravity 212. In other words: the cross-sectional area is point-symmetrical. In reality, the manufacturing process or the shape of the tool used during the manufacturing process with the starting material may cause slightly different surface shapes of the ear areas 206, wherein a shape having maximum symmetry will be preferred.

This shape may be achieved by a manufacturing process of the contact pin 100, in which process two opposite beads 110 are stamped into a starting strip material in the crimp zone 104, as described above, wherein the material from the central area in the crosspiece area 202 will be compacted and thus hardened, and at the same time material is passed into the wing areas 204 and into the ear areas 206, where it becomes especially ductile, so that when the contact pin 100 is press-fitted into the through-hole 300, it is mainly the ear areas 206 that will be deformed in the direction of the bead 110.

In the exemplary production of the crimp zone 104 by stamping the beads 110, the crosspiece area 202 in the Y-direction is limited on both sides by the bead base 116 of bead 110. This will result in crosspiece thickness DS. In the X-direction, the crosspiece area 202 is as wide as the bead base 116, which will result in the crosspiece width BS. For example, the crosspiece edge 117 may correspond to bead base 116. Preferably, the crosspiece area 202 is essentially rectangular. A rectangular shape creates especially high moment of inertia per unit area, which reduces or even prevents the crosspiece area 202 from being compressed during press-fitting.

A wing area 204 extends in the X direction from the end of the bead base 116 to an outer contour 208 of the cross-sectional area 200, the outer contour 208 resulting as the intersection line of the cross-section with the surface 112 of the contact pin 100. In the Y-direction, the wing areas 204 each occupy the area that laterally adjoins the crosspiece area 202.

An ear area 206 extends in the Y-direction from the extension of the crosspiece area 202 in X-direction into the respective wing area 204 up to the outer contour 208 in positive or negative Y-direction. In the X-direction, the ear area 206 extends from the end of the bead base 116 to the outer contour 208.

The outer contour 208 of an ear area 206, which faces towards an outer corner 209 of the corresponding ear rectangle 210 (e.g. the upper left ear area 206 in FIG. 3) may be blunt rounded with a radius R. This radius R may, for example, be between 6% and 26% of the starting material thickness 108. The outer contour 208 comes into contact with the wall 305 or the coating 308 when press-fitted into the through-hole 300.

The outer contour 208 of the surface 112 of the contact pin 100, which is located further inwards, i.e. further towards the bead 110, declines towards the bead 110, i.e. to the crosspiece area 202, and herein, the bead flanks 118 are configured as bevels 118. These bevels 118 each have an angle ♋ in relation to the crosspiece edge 117 of the crosspiece rectangle 214 of the crosspiece area 202, which extends in the X-direction. The angle ♋ is always taken between the bevel 118 and the crosspiece edge 117, which may also be the bead base 116. The angle ♋ may be between 95° and 135°, preferably between 105° and 128°, e.g. 120°.

Thus, although the ear areas 206, as shown in FIGS. 3*a* and 3*b*, may not have a starting rectangular shape, they may still be described by the ear rectangles 210. Namely by a minimal ear rectangle 210, into which the surface area of the respective ear area 206 is just exactly inscribed. The common inner corner points 211 of the ear rectangles 210 and the crosspiece rectangle 214 are given by the point, where the bevel 118 or the inward facing flank of the ear area 206 intersects the crosspiece edge 117.

In other words: The inner corner points 211 of the ear rectangles 210 facing the center of gravity 212 of the cross-sectional area 200 correspond to the corner points of a crosspiece rectangle 214 (minimally) confining the crosspiece area 202.

Due to this cross-sectional area 200, the contact pin 100 in the crimp zone 104 comprises the following: a spring area (the crosspiece area 202 as well as the laterally adjacent to areas not representing ear areas 206) which is continuous in the X-direction (in FIGS. 3*a* and 3*b* from left to right) and four deformation areas projecting beyond the spring area in the Y-direction (ear areas 206).

An edge distance A1 may be set between two edges 207 of two ear rectangles 210, which are facing away from the center of gravity 212 and are opposite to the center of gravity 212—e.g. between the two ear rectangles 210 depicted in the figure in the upper left panel and in the upper right panel, and their outer edges 207. Or also between the two ear rectangles 210 depicted in the figure in the lower left panel and in the lower right panel, and their outer edges 207. In the first state (uncrimped state), this edge distance may be e.g. between 129% and 149% of the starting material thickness 108, preferably between 134% and 144%, e.g. 139% of the starting material thickness 108.

An imaginary line between the outer corners 209 of two ear rectangles 210, which are diametrically opposed to each other with respect to the center of gravity 212, sets a diagonal distance A2. On the same line, a round-blunting distance A3 is set, which represents the intersection of the diagonal distance line A2 and the outer contour 208 of the ear areas 206 (see FIG. 3*b*).

The diagonal distance A2 may preferably be between 145% and 165% of the starting material thickness 108.

The round-blunting distance A3 may preferably be between 129% and 149% of the starting material thickness 108, especially preferably between 134% and 144%, e.g. 139%.

In other words, in FIGS. 3*a* and 3*b* a cross-sectional area 200 of the crimp zone 104 is represented, which can deform such that the wall 305 of the through-hole 300 in the circuit board 302 will not be damaged, if possible. This will be achieved, among other things, in that when press-fitting, it is mainly the outer areas of the ear areas 206 that are deformed, whereby a large area of the crimp zone 104 is forced against the wall surface or the coating 308 of the wall 205. This reduces pressure on individual surface segments, as the radially outward force is distributed across a large area during press-fitting.

In addition, the ear areas 206 are rounded at their outer contours 209 facing outwards towards wall 305, which further increases the contact surface and prevents sharp-edged effect on the wall 305 or the coating 308 of the through-hole 300. The geometry of the cross-sectional area 200 still has enough recesses (cavity in the bead 110 between the ear areas 206 in the X-direction) into which excess material may be deformed during the press-fit process.

At the same time, the crosspiece area 202 is particularly stiff, due to its essentially rectangular shape having a greater crosspiece thickness DS than crosspiece width BS (the moment of inertia in the X-direction for the crosspiece rectangle $I_x = 1/12 \times DS^3 \times BS$) and eventually is even more compacted by the manufacturing process, making it very resistant to deformation along the X-direction. Therefore, when press-fitting, it is not the crosspiece area 202 or a needle-eye-shaped spring area that deforms, as it is the case in current prior art, but instead, the four outward facing ear areas 206 are adapt to the geometry of the through-hole 300, whereas the crosspiece area 202 is only slightly deformed or not at all.

Briefly, this results in increased surface pressing contact. However, the force is not only distributed to the four outer corner points, as would be the case with a rectangular pin, but along the contact surfaces.

Another advantage is that different materials having desired properties such as electrical conductivity, density or lower material costs may be used, e.g. aluminum or an aluminum alloy.

Figure 4:
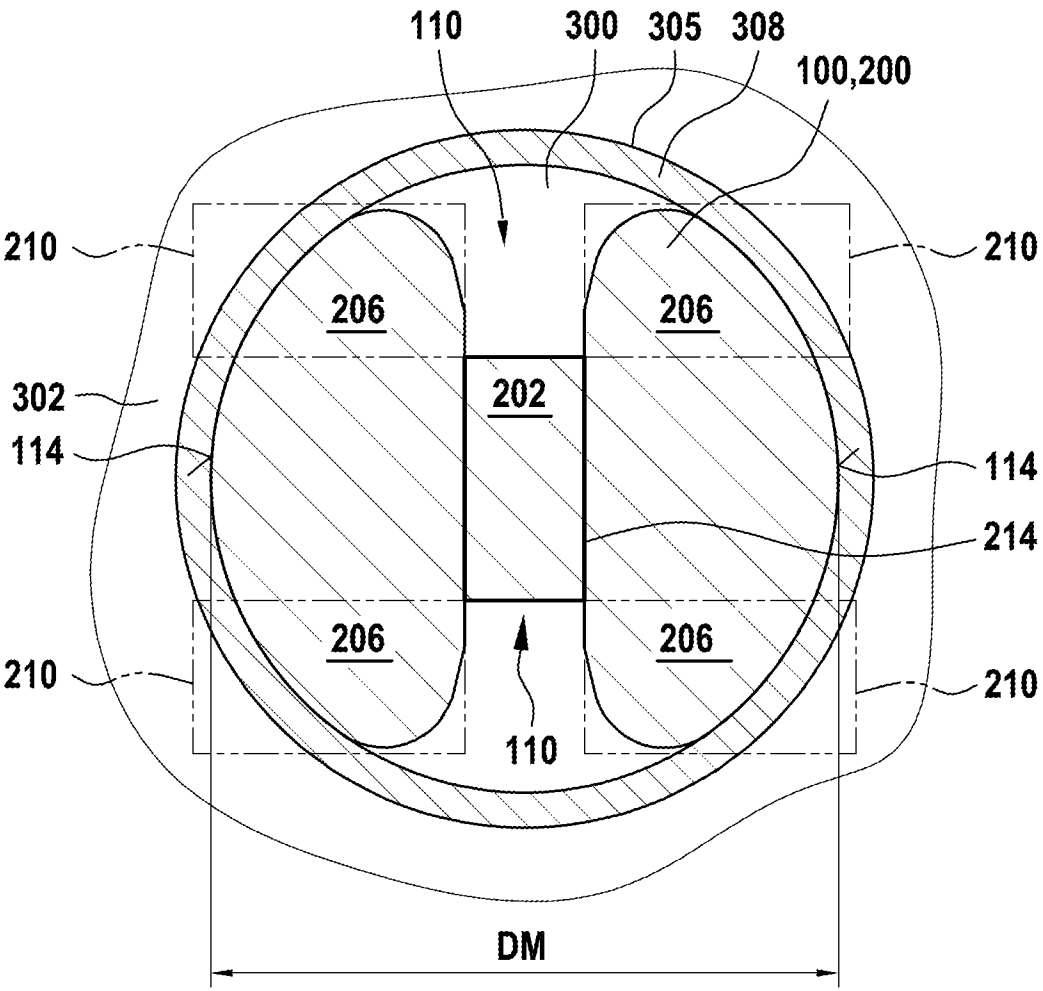
FIG. 4 is a schematic view of the cross-section of the crimp zone of the contact pin of FIG. 2 in a (second) state press-fitted into a printed circuit board.
Figure 4:
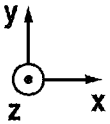

FIG. 4 shows a schematic view of the cross-section of the crimp zone 104 of the contact pin 100 of FIG. 2 in a (second) state press-fitted into a printed circuit board 302, e.g. as shown in FIG. 1.

The contact pin 100 essentially corresponds to the contact pin in the FIGS. 2, 3*a* and 3*b*. Contrary to this, herein the contact pin 100 is deformed by the forces during press-fitting into the through-hole 300.

The through-hole 300 may have a diameter between 113% and 133% of the starting material thickness 108, preferably between 118% and 128% of the starting material thickness, e.g. 123%.

When press-fitting the contact pin 100 from the first side 304 of the printed circuit board 302 it slides against the coating 308 of the through-hole 300 and into the through-hole 300. Especially, as the round-blunting distance A3 in the first state of the contact pin 100 is greater than the diameter DM of the through-hole 300, the ear areas 206 are deformed in the direction of the beads 110. The central crosspiece area 202, on the other hand, is deformed only slightly or not at all.

During press-fitting, the resulting forces also act on the crosspiece area 202, which, however, has a large cross-section such that the crosspiece area 202 is not or only slightly deformed. If a minimum crosspiece rectangle 214 is described around the crosspiece area 202 in the second state, said crosspiece rectangle 214 in the second state is essentially congruent with the crosspiece rectangle 214 in the first state. In other words: the crosspiece area 202 has not (significantly) deformed. A in-flow of portions of the ear areas 206 into the bead 110 does not counteract the shape of the crosspiece rectangle 214, as the bead base 116 or the crosspiece edge 117 limit the dimension of the crosspiece rectangle 214 in the Y-direction.

In contrast to the crosspiece area 202, the ear areas 206 are permanently plastically and thus proportionately elastically deformed during transition into the second state. Through the plastic deformation, the outer contour 208 adapts to an inner contour of the wall 305 or the coating 308 of the through-hole 300. This results in a large electrically conductive contact area 114 between the metal layer 304 and the contact pin 100. To illustrate the difference between the ear areas in the second (crimped) state and the first state (pre-assembled state), in FIG. 4, an example of the ear rectangles 210 in the first state is depicted with dotted lines. It is obvious, how the ear areas 206 have been deformed from the first state of FIGS. 3*a* and 3*b* to the second state of FIG. 4.

The crimped contact pin 100 shown herein is only represented schematically, including a completely point-symmetrical deformed cross-sectional area 200. In practice, deformation in the four ear areas 206 nevertheless may occur in a slightly different way, e.g. if the press-fitting direction E is not completely aligned with a longitudinal axis of the through-hole 300.

As already shown in FIG. 1, even in printed circuit boards having a thickness of 0.8 mm to 2.4 mm only, e.g. 1.6 mm+/−10%, adjacent through-holes 300 may have a through-hole distance A4 in the range of 300% to 425% only, preferably 330% to 390%, e.g. 364% of the starting material thickness 108. Surprisingly, such a low through-hole distance A4 may only be obtained because of the specific geometry of the crimp zone 104 of the contact pin 100. Only due to the large contact area of the ear areas 206, and the fact that mainly the ear areas 206 deform during press-fitting, the walls 305 of the through-holes 300 are much less exposed to a load than when using conventional contact pins. Therefore, the through-hole distance A4, across the length of which mechanical stresses may be discharged to prevent damage to the printed circuit board 302, may be reduced considerably compared to conventional contact arrangements 500. In turn, the packing density of the contact pins 100 in the printed circuit board 302 increases in the present contact arrangement 500 or the contact pin 100, provided herein.

The geometry of the present contact pin 100 or of the crimp zone 104 allows for secure and persistent mounting of the contact pin 100 in the through-hole 300 to be achieved, even when using soft or ductile material, e.g. aluminum or aluminum alloys for the contact pin 100.

Finally, it is also possible to use a strip material having larger starting material thickness 108 in relation to the diameter DM of the through-hole 300 than when using conventional contact pins 100. Thus, completely by surprise, the through-hole 300, as a diameter DM, may only comprise between 113% and 133% of the starting material thickness 108, e.g. 120% or 125%. In comparison, the diameter DM of the through-hole of conventional contact pins is between 150% and 185% of the initial material thickness 108.

This starting material having higher bulkiness (higher starting material thickness), as compared to conventional contact pins, which is useful in the invention, may, on the one hand, result in improved current-carrying capacity, and, on the other hand, use of softer materials (e.g. aluminum or an aluminum alloy) as a contact pin 100 is allowed, as the filling factor of the contact pin 100 in the through-hole 300 increases and the forces required for press-fitting can also be transmitted to the contact pin 100 along the press-fit direction E without any risk of bending. At the same time, damage-free press-fit will be maintained, due to improved distribution of forces, as described above, as a result of inward deformation of ear areas 206 and reduced pressure on the wall 305 of the through-hole resulting therefrom.

For example, for a printed circuit board 302 having a thickness of 1.6 mm+/−10%, and a diameter DM of the through-hole 300 being 1.0 mm, a strip material having a square cross-section of 0.8×0.8 mm2 may be used instead of 0.6×0.6 mm2, which is conventionally used.

Due to the larger contact area between the crimp zone 104 of the contact pin 100 and the wall 305 or coating 308, it is also possible to reduce the crimp zone length LV of the crimp zone 104 along the press-fit direction E, which means that the projection or the length L of the tip area 102 projecting beyond the second side 306 of the printed circuit board 302 may be reduced without negatively affecting the press-fit process or the retention force.

For example, for the dimensions given above, the length L of the projection beyond the second side 306 may be less than 30% of the thickness D of the printed circuit board (e.g. D=1.6 mm+/−10%), namely only approx. L=0.3 mm+/−10%. The contact pin 100 may predominantly be made of aluminum. In the second state, such contact arrangement 500 has the same pull-out forces or the same retention force, respectively, for the contact pin 100 and the same service life as conventional contact arrangements 500.

Finally, it should be noted that the reference numbers used in the claims are not intended to be a limitation of the invention.

The invention claimed is:

1. An electrically conductive contact pin for press-fitting along a press-fit direction into a through-hole of a printed circuit board, wherein the press-fit direction of the contact pin is defined as a Z-direction, perpendicular to the Z-direction, an X-direction is defined, and perpendicular to the Z-direction and the X-direction, a Y-direction is defined, wherein the contact pin comprises a crimp zone, the crimp zone, in a cross-sectional area of the contact pin, spanning across the X-direction and the Y-direction, the crimp zone comprising:

a central crosspiece area having two opposite crosspiece edges which are substantially parallel to the X-direction, two wing areas adjacent to the crosspiece area in a positive X-direction and a negative X-direction, wherein each of the two wing areas comprises two ear areas, wherein one of the two ear areas of each of the two wing areas projects beyond the crosspiece area in a positive Y-direction, and another of the two ear areas of each of the two wing areas projects beyond the crosspiece area in a negative Y-direction, wherein the crosspiece area is limited by a crosspiece rectangle, wherein the two ear areas are limited by ear rectangles, wherein inner corner points of the ear rectangles facing a center of gravity of the cross-sectional area coincide with corner points of the crosspiece rectangle, wherein the crosspiece rectangle, in the X-direction, has a crosspiece width between 9% and 29% of a starting material thickness of the contact pin, and, in the Y-direction, has a crosspiece thickness of between 35% and 55% of the starting material thickness, wherein the ear rectangles, in the X-direction, have an ear width of between 40% and 60% of the starting material thickness, and in the Y-direction, have an ear thickness of between 15% and 35% of the starting material thickness.

2. The contact pin according to claim 1, wherein an edge distance between two edges of two of the ear rectangles facing away from the center of gravity and opposite to each other relative to the center of gravity is between 129% and 149% of the starting material thickness.

3. The contact pin according to claim 1, wherein a diagonal distance between outer corners of two of the ear rectangles, which outer corners are diametrically opposite to each other with respect to the center of gravity, is between 145% and 165% of the starting material thickness.

4. The contact pin according to claim 1, wherein an outer contour of one of the two ear areas, which faces towards an outer corner of an associated one of the ear rectangles, is rounded with a radius, wherein the radius is between 6% and 26% of the starting material thickness.

5. The contact pin according to claim 3, wherein a round-blunting distance, as measured on a line of a diagonal distance between two outer contours opposite to each other relative to the center of gravity, is between 129% and 149% of the starting material thickness.

6. The contact pin according to claim 1, wherein at least one of the two ear areas has a bevel on a side facing the crosspiece area in the X-direction, wherein the bevel has an angle relative to the crosspiece edge of the crosspiece rectangle of the crosspiece area, wherein the angle is between 95° and 135°.

7. The contact pin according to claim 1, wherein the two ear areas are arranged and formed substantially mirror-symmetrical to each other with respect to the crosspiece area.

8. The contact pin according to claim 1, wherein the contact pin comprises a tip region in the Z-direction which directly adjoins the crimp zone and extends up to a free end of the contact pin, wherein the cross-section of the contact pin tapers towards the free end in the tip region, wherein the tip region has a tip region length in the Z-direction between 60% and 300% of the starting material thickness.

9. The contact pin according to claim 1, wherein the starting material predominantly comprises a material selected from the group consisting of aluminum, an aluminum alloy, copper, a copper alloy, bronze, and brass.

10. A contact arrangement, comprising:

a printed circuit board having a through-hole extending along the Z-direction a contact pin according to claim 1, wherein the contact pin is crimped in the through-hole.

11. The contact arrangement according to claim 10, wherein the printed circuit board has a thickness between two opposite sides, a first side and a second side, as viewed along the Z-direction, wherein, in a fully press-fitted state of the contact pin, a front free end of the contact pin, as viewed along a press-fit direction, projects in the Z-direction along a length beyond the second side of the printed circuit board, wherein the length beyond the second side of the printed circuit board is in a range between 10% and 300 of the thickness of the printed circuit board.

12. The contact arrangement according to claim 10, wherein the through-hole has a diameter between 113% to 133% of the starting material thickness.

13. The printed circuit board according to claim 10, wherein a through-hole distance from the through-hole to an adjacent through-hole of another contact pin is between 300% and 425% of the starting material thickness.

14. The contact arrangement according to claim 11, wherein the length beyond the second side of the printed circuit board is in a range between 10% and 110%.

15. The contact arrangement according to claim 14, wherein the thickness of the printed circuit board is between 0.8 mm and 2.4 mm.

16. The contact arrangement according to claim 11, wherein the thickness of the printed circuit board is between 0.8 mm and 2.4 mm.

* * * * *